United States Patent [19]

Fowler et al.

[11] Patent Number: 4,865,061

[45] Date of Patent: Sep. 12, 1989

[54] DECONTAMINATION APPARATUS FOR CHEMICALLY AND/OR RADIOACTIVELY CONTAMINATED TOOLS AND EQUIPMENT

[75] Inventors: David E. Fowler, Gainesville; Charles R. Witt, Crystal River, both of Fla.

[73] Assignee: Quadrex Hps, Inc., Gainesville, Fla.

[21] Appl. No.: 515,995

[22] Filed: Jul. 22, 1983

[51] Int. Cl.[4] ..... B08B 3/02; B08B 3/12; B08B 15/02

[52] U.S. Cl. ..... 134/108; 134/109; 134/113; 134/172; 134/184

[58] Field of Search ..... 134/1, 10, 12, 108, 134/109, 113, 172, 184; 68/18 R, 18 C, 18 F; 252/626, 630, 631

[56] References Cited

U.S. PATENT DOCUMENTS

| | | | |
|---|---|---|---|
| 2,270,609 | 1/1942 | Smith | 68/18 R X |
| 2,660,869 | 12/1953 | McDonald | 68/18 R |
| 3,024,138 | 3/1962 | Schlott | 134/1 |
| 3,100,724 | 8/1963 | Rocheville | 118/326 X |
| 3,372,704 | 3/1968 | Ashworth | 134/109 |
| 3,388,567 | 6/1968 | Oles | 68/18 R |
| 4,235,600 | 11/1980 | Capella et al. | 252/626 X |
| 4,443,269 | 4/1984 | Capella et al. | 252/630 X |
| 4,561,903 | 12/1985 | Blaul | 134/10 |

FOREIGN PATENT DOCUMENTS

| | | | |
|---|---|---|---|
| 2756145 | 6/1979 | Fed. Rep. of Germany | 252/626 |
| 2840138 | 3/1980 | Fed. Rep. of Germany | 252/626 |

*Primary Examiner*—Philip R. Coe

*Attorney, Agent, or Firm*—Bernard A. Reiter; Mark G. Bocchetti

[57] ABSTRACT

Disclosed is a self-contained, portable apparatus for cleaning chemical and/or radioactively contaminated articles. A cleaning chamber is provided where contaminated articles are placed. Solvent from a solvent reservoir is sprayed onto the contaminated articles to dissolve the chemical contaminants and to dislodge the radioactive particulates. The solvent and contaminants drain through a short vertical duct connecting the cleaning chamber to the solvent reservoir. There is a cooling means present in the short vertical duct which serves to condense the solvent vaporized during the cleaning operation. A filter means is provided to filter particulate contaminants from the solvent before the solvent is delivered from the solvent reservoir to the cleaning chamber. A high efficiency particulate air filter and an adsorber are connected in series such that the initial atmosphere contained within the cleaning chamber is vented to atmosphere through the high efficiency particulate air filter in the absorber during the initial increase in pressure within the cleaning chamber when spraying of the solvent is commenced. As the cooling means condenses the solvent vapor, the pressure within the apparatus is reduced to subatmospheric pressure thus preventing the possibility of leak of contamination from the apparatus into the atmosphere.

11 Claims, 3 Drawing Sheets

DECONTAMINATION APPARATUS FOR CHEMICALLY AND/OR RADIOACTIVELY CONTAMINATED TOOLS AND EQUIPMENT

BACKGROUND OF THE INVENTION

The present invention relates generally to a decontamination device. More specifically, the present invention relates to a decontamination device for chemically or radioactively contaminated tools and equipment including respirators, electronic equipment and microelectronic related materials.

DESCRIPTION OF THE PRIOR ART

In certain industrial enterprises, such as in the production of pesticides, hazardous chemicals, electronics, opticals and nuclear energy, the surfaces of tools, small parts, and pieces of equipment become contaminated with foreign particulates and films. In order to assure proper functioning of such equipment and, in some instances, the safety of personnel, these articles must be decontaminated.

One method for accomplishing the decontamination of articles was disclosed in U.S. patent application Serial No. 228,971, and now U.S. Pat. No. 4,443,269 dated January 22, 1981. The "Tool Decontamination Apparatus" revealed therein accomplished decontamination by spraying the articles with a clean solvent at high pressure. Such spraying was carried out in a sealed cleaning chamber having an access door which housed glove parts for operator access thereto. The operator reaches inside the cleaning chamber by means of the gloves and manipulated a spray gun to direct a high pressure solvent spray against the articles being decontaminated.

Solvent sprayed onto the contaminated articles was drained from the cleaning chamber at a rate equal to or greater than the rate at which it was sprayed into the chamber. The drained solvent passed through piping and across a macro-particle trap, which was mounted external to the chamber. It was then drained into a solvent reservoir, where it was stored for reuse. Reused solvent was filtered before being sprayed in the cleaning chamber and a portion sprayed over the system's condensing coil to cool the solvent and prevent overheating of the solvent. The Tool Decontamination Apparatus also included a fan for exhausting solvent vapors from the cleaning chamber across an external condensing coil for purposes of condensing solvent vapors into a liquid so as to minimize solvent loss when removing articles and minimize internal system vapor pressure. A still was provided for periodic batch distillation of the solvent for removal of dissolved contaminants.

The prior art device was relatively successful at achieving decontamination of articles, but it suffered a number of problems. One of the problems was with the size of the apparatus which measured 67"×76"×72" (length, width and height). Because of its large size, the apparatus occupied a large amount of floor space, and required large, non-standard openings to enter and exit facilities. The large size also caused the apparatus to be heavy, and relatively cumbersome and immobile. It required special equipment handling machines to move it about a facility.

Another concern centered around the solvent cooling coil which was mounted external to the cleaning chamber in a separate housing. This arrangement required piping in order to process the solvent liquid and vapors through the cooling coil. The piping requirements, along with the large size, caused this to be an expensive apparatus.

Still further, as previously mentioned, the unit's access door also housed the glove ports for operator access to the cleaning chamber. This required the operator to detach himself from the machine while items were loaded and/or unloaded from the cleaning chamber. Orientation of the gloves in the door required the operator to bend over the machine while operating, resulting in considerable fatigue when operating for several hours.

SUMMARY OF THE INVENTION

In view of the foregoing, it is an object of the present invention to disclose a decontamination apparatus of a design that is simpler and more compact than that of the device revealed in the prior art, while maintaining essentially the same cleaning chamber capacity.

It is another object of the present invention to provide an apparatus having the capability to decontaminate by spraying appropriate solvents at variable pressures.

It is still another object of the present invention to provide an apparatus having the capability of decontaminating through the use of ultrasonics.

It is still a further object of the present invention to provide an apparatus which entails the capability of remote spraying of contaminated articles in certain potentially hazardous situations.

DESCRIPTION OF THE PREFERRED EMBODIMENT

Figure 1:
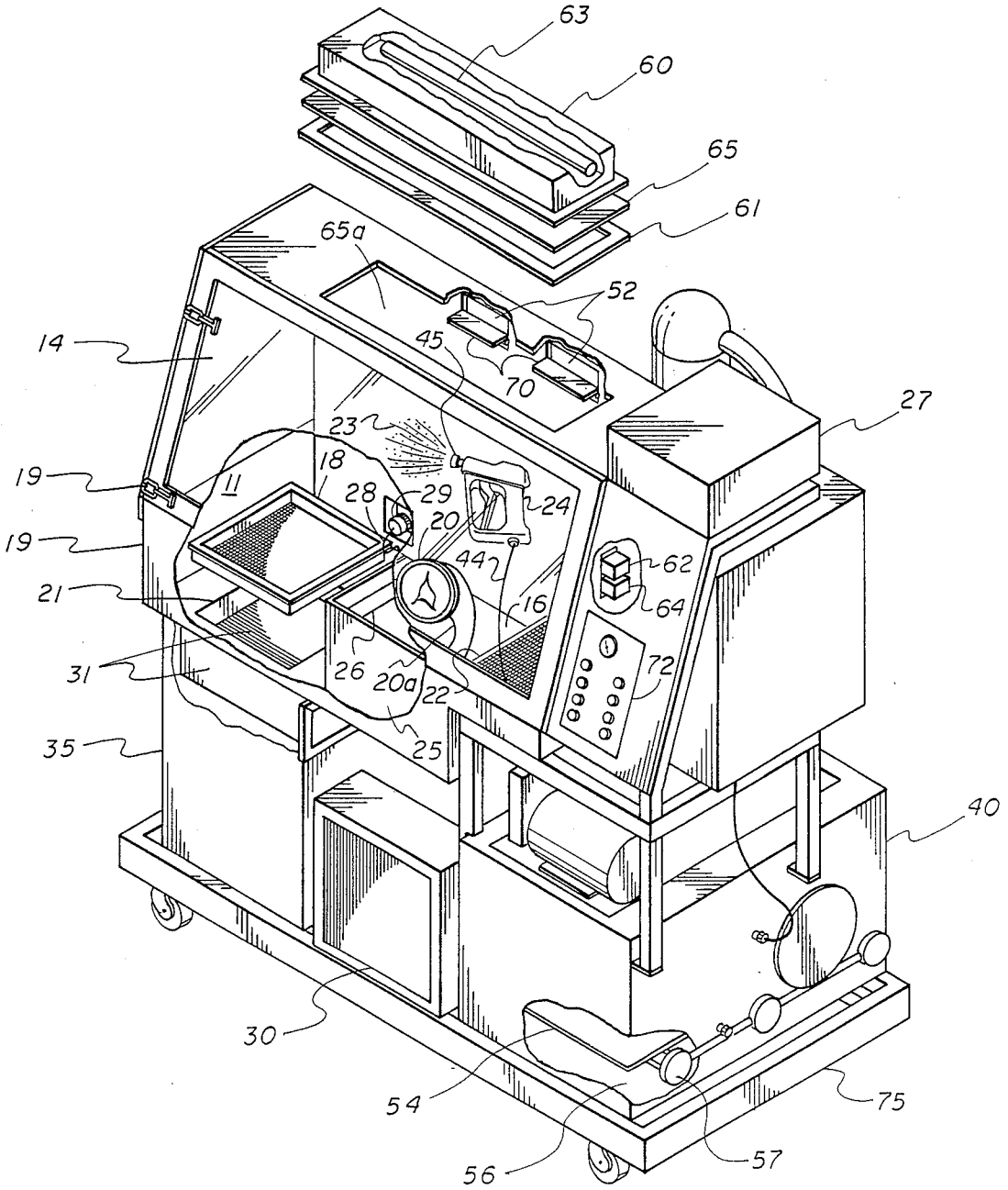
FIG. 1 is a front perspective view of the decontamination apparatus of the present invention.

In brief, articles are decontaminated by the present invention by using either a variable pressure solvent spray, or by using high frequency ultrasonic agitation in a solvent bath. Decontamination is performed in a sealed cleaning chamber, whereby the operator and the surrounding areas are protected from the spread of contaminants. Contaminants removed during the cleaning process are transported by the solvent to the systems's solvent reservoir. Contaminants in the solvent are then removed and isolated by filtration and/or distillation for safe disposal.

The cleaning chamber is designed to allow flexibility as to the cleaning process utilized, the region of the chamber in which cleaning is performed, and the chamber volume available for cleaning. The chamber is divided into an upper and lower region by a removable grating. When using the solvent spray cleaning process, the operator rests the article being decontaminated on the grating in the upper portion of the chamber. The operator then reaches into the chamber and manipulates a manually operable spray gun to direct the spray against the article. Where the operator is threatened with excessive exposure from radiation or other hazards, a spray manifold may be incorporated to spray the contaminated item remotely. The mechanical action of the spray and the chemical action of the solvent act remove the contaminants from the surface of the object. The solvent flushes the contaminants from the surface of the object, then falls through the grating to the floor of the chamber. The floor of the chamber is sloped toward one end where a large opening is provided for draining the solvent directly to the solvent reservoir. A cooling coil is installed below the opening in the chamber (between the chamber and solvent reservoir) so that all solvent drained from the chamber by gravity, must pass through this coil before returning to the solvent reservoir.

The ultrasonic cleaning tank rests on the floor of the cleaning chamber, in the lower region below the grating. To use the ultrasonic cleaning tank, the operator will normally remove only the section of grating directly above the tank. Articles to be cleaned are loaded through the cleaning chamber door and stacked on the grating adjacent to the tank. As they are cleaned, they are placed on the grating on the opposite side of the tank for drying. In this manner, large numbers of items may be cleaned in the ultrasonic tank without continuously reloading through the chamber door.

The ultrasonic cleaning function allows for the cleaning of articles too delicate or intricate for cleaning by the solvent spray process. Ultrasonic cleaning utilizes the scrubbing action of imploding liquid vapor bubbles to loosen and remove contaminants from an article. The ultrasonic cleaning tank is filled with solvent by means of the same manually operated spray gun used in the solvent spray process. The tank is equipped with a drain so that it may be periodically emptied and refilled with fresh solvent.

Approximately 16 cubic feet of space is available for cleaning volume inside the cleaning chamber. However, the operator may remove the grating and ultrasonic cleaning tank from the chamber to provide another 2.5 cubic feet for purposes of cleaning larger objects. A transducer for the ultrasonic cleaning tank is removable from the chamber by unplugging it from a receptacle mounted on the chamber's rear wall.

Solvent drained from the cleaning chamber int the solvent reservoir is continuously pumped from the reservoir by a low pressure pump through a filter, and returned to the reservoir. This process removes particulate contaminants from the solvent. The filter(s) may also be replaced or operated in series with adsorbers which remove soluable contaminants by physical and/or chemical adsorption. The low pressure pump also communicates filtered and/or adsorbed solvent to a high pressure pump. The high pressure pump, in turn, communicates solvent to the cleaning chamber for the solvent spray cleaning process and/or for the purpose of filling the ultrasonic cleaning tank. This process assures that only clean solvent will contact of the contaminated articles.

The small latent heat of vaporization and low boiling point of the solvent allows decontaminated articles to be dried rapidly. After decontamination is complete (using either solvent spray or ultrasonics), the operator starts a drying fan. Air is circulated into the cleaning chamber via ports at the top of the chamber through the chamber (where it evaporates residual liquid solvent) across the cooling coil, and back to the inlet of the fan. The cooling coil condenses solvent vapors from the recirculating air, communicates the liquid solvent to the solvent reservoir, and leaves the air with additional capacity to transport solvent vapor.

The present invention is also adapted to operate external cleaning chambers. This enables specialty cleaning chambers to be built to accommodate articles for decontaminating that are too large or cumbersome for the cleaning chamber. When operating external equipment, solvent is communicated via high pressure hose to the external chamber for spraying. The expended solvent is collected and pumped back to the solvent reservoir on the apparatus via a portable hose, where it is filtered and processed in the usual manner before being reused. Fittings are provided so that drying air may also be recirculated from the external chamber to the apparatus and back to the external chamber by employing flexible air ducts.

When solvent is first sprayed into the cleaning chamber of the apparatus, a pressure surge is created by the partial vaporization of the solvent. This pressure is relieved by passing the vapor/air mixture across the condensing coil, through a high efficiency particulate air (HEPA) filter to remove potential vapor/air suspended particulate contaminants, and then an activated carbon vapor trap that removes solvent vapors. This initial venting is automatic and causes a major portion of the system's air to be communicated outside the machine in a safe and contamination-free fashion. The remaining atmosphere is largely solvent vapor which condenses rapidly due to the condensing coil and absence of air. This condensation creates a negative atmospheric pressure relative to the outside atmosphere. The frictional resistance through the HEPA filter and carbon column impede the complete equalization of atmospheric pressure between the invention and the outside environment. This slight negative pressure is beneficial since it aids in preventing the escape of solvent vapors and contaminants from the apparatus.

Figure 2:
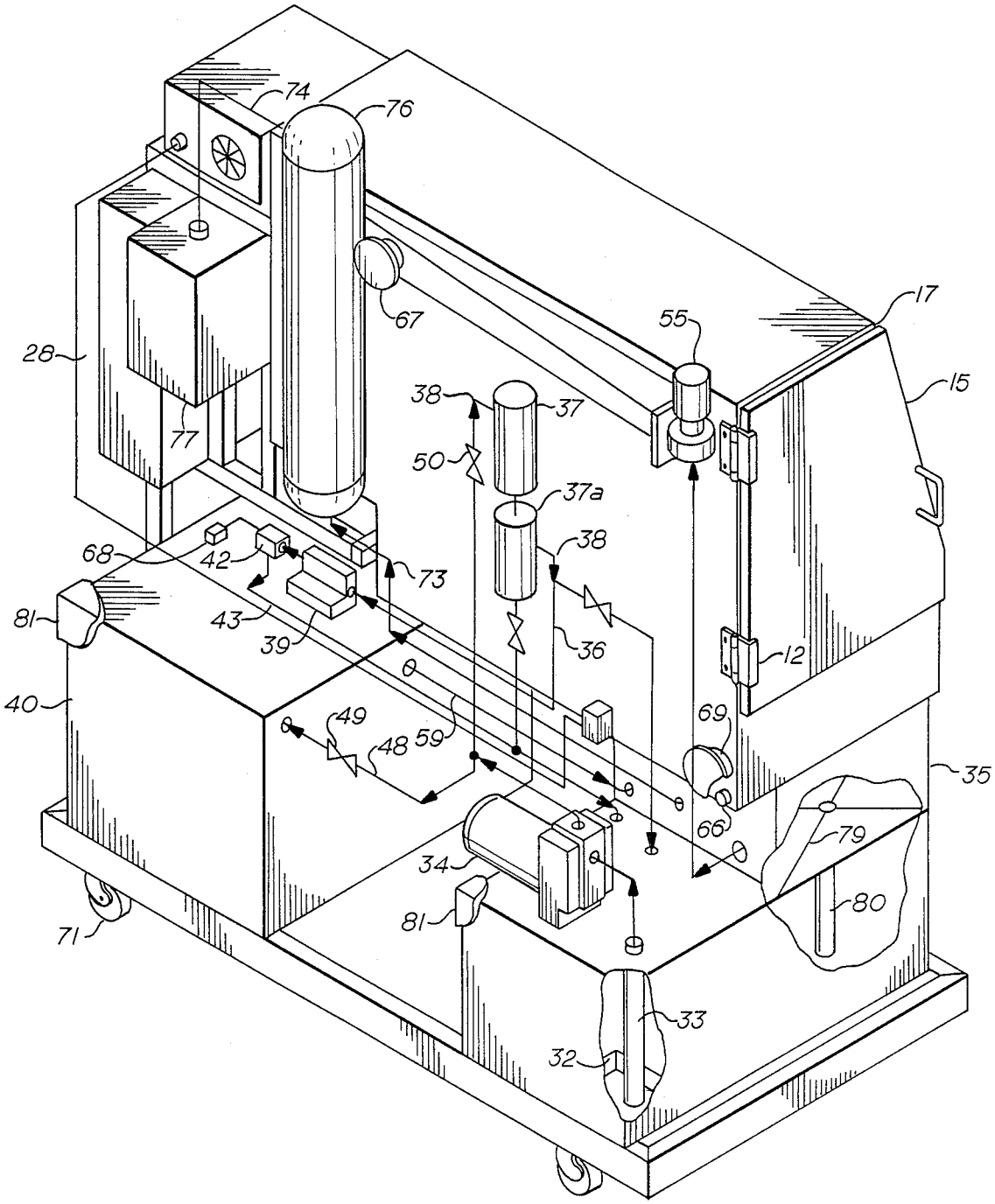
FIG. 2 is a rear perspective view of the decontamination apparatus of the present invention.
Figure 3:
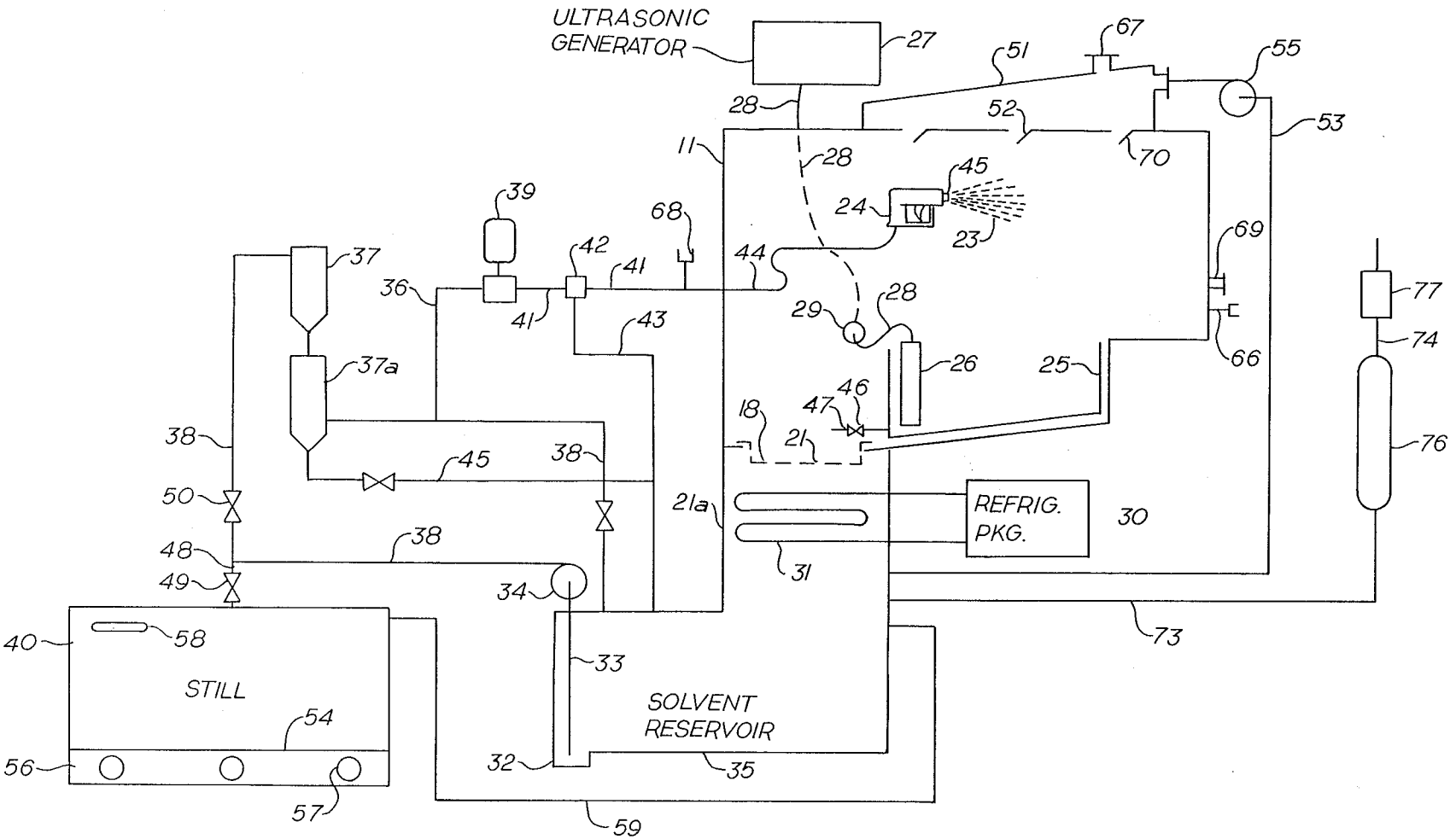
FIG. 3 is a schematic illustration of the preferred embodiment of the present invention.

Referring now to the drawings, the apparatus of the present invention is illustrated perspectively in FIGS. 1 and 2, showing therein front and rear views respectively. FIG. 3 is schematically illustrative of the system disclosed herein. Such illustrations are adapted to depict the present decontamination apparatus and are shown for purposes of convenience in understanding the operation and function of the invention.

The system includes a cleaning chamber 11 which is adapted to contain the articles to be cleaned. The cleaning chamber 11 includes a cabinet 13 with a door 15 hingedly connected thereto. A gasket 17 is provided to form a gas tight seal between cabinet 13 and door 15 when cleaning chamber 11 is closed. Hinges 12 are slotted and bolted to cabinet 13 so that adjustments may be made as gasket 17 compressibly changes with use. A plurality of latches 19 are provided for securely latching door 15 in the closed position.

Door 15 includes a window 14 through which an operator may view the interior cleaning chamber 11 when door 15 is closed. Window 14 has mounted thereto a pair of glove port rings 20 to which are attached a pair of impermeable gloves **20*a*, by which the operator may manipulate articles within the cleaning chamber 11 from the exterior of the chamber 11 so as to keep the chamber 11** sealed during the cleaning process.

The interior of cabinet 13 includes a bottom 16 which slopes downwardly toward drain opening 21. Mounted in drain opening 21 is trap 18 adapted to capture macroscopic objects removed in the cleaning process, and which, if allowed to leave chamber 11 via drain 21, might damage cooling coil 31 or solvent pump 34. Drain opening 21 allows solvent to pass from cleaning chamber 11 through vertical duct 21*a* directly into solvent reservoir 35.

Resting on cabinet bottom 16 is ultrasonic cleaning tank 25. Supported in ultrasonic cleaning tank 25 is an ultrasonic transducer 26, such transducer 26 being operatively connected to ultrasonic generator 27 by cable 28. To provide additional cleaning volume within cleaning chamber 11, ultrasonic transducer 26 and tank 25 may be removed from cabinet 31 through door 15. In order to accomplish such removal, cable 28 must be unplugged from receptacle 29 which is liquid and vapor tight so as to prevent the escape of cleaning solvent from cleaning chamber 11.

Grating 22 is provided in cleaning chamber 11 and is mounted above the region in which ultrasonic cleaning tank 25 is located. Objects to be decontaminated are passed into the cleaning chamber 11 through door 15, which is then latched and sealed shut by clamps 19. The operator has the choice of decontaminating objects by either solvent spray, or by ultrasonic cavitation. If the operator chooses solvent spray, the object is rested on grating 22 and the operator reaches into the cleaning chamber 11 through gloves 20 to manipulate solvent spray gun 24 to direct the high pressure solvent spray 23 against the object. The hydraulic pressure of the solvent spray may be adjusted by changing the nozzle 45 or the high pressure pump unloader valve 42. Hydraulic pressures ranging between 0 psig and 2150 psig are achieveable with this system. The operator has the additional advantage of being able to manipulate the object while spraying. Due to the solvent's proper ties, the spraying process generates vapors of the solvent. By performing the spraying inside sealed cleaning chamber 11, none of the solvent nor contaminants escape to the outside environment during the cleaning process.

Grating 22 is provided in three removable sections, so that if the operator chooses to decontaminate by ultrasonic cavitation he removes only the section of grating 22 above tank 25. The operator then reaches into cleaning chamber 11 through the gloves 20 and immerses the object into tank 25 to perform the ultrasonic decontamination. By performing the ultrasonic decontamination inside sealed cleaning chamber 11, none of the solvent vapors generated by the process can escape to the outside environment.

The apparatus herein has the capability to decontaminate by using either of two processes. In the solvent spray process, solvent sprayed by spray gun 24 against the article inside cleaning chamber 11 passes through grating 22 onto chamber bottom 16, carrying with it contaminants removed from the article being cleaned. The solvent/contaminant mixture flows through drain 21 at a rate at least as great as that at which solvent is sprayed into chamber 11. The solvent/contaminant mixture flows through cooling coil 31. The cooling coil 31 serves to maintain the solvent in the apparatus at a temperature substantially below its boiling point, thus minimizing the amount of solvent vapors generated during the decontamination process. Cooling coil 31 is operated by conventional refrigeration equipment 30. It is then collected by pan 79 and communicated to solvent reservoir 35 via drain pipe 80. The combination of pan 79 and drain pipe 80 also serves as a vapor shield for solvent reservoir 35 in that the surface area of solvent in the reservoir being exposed to the system's air flow is limited to the cross sectional area of drain pipe 80 as opposed to the entire surface area of the reservoir. This minimizes the formation of solvent vapors when the fan is operating and consequently reduces condensing requirements as well as accelerates the drying cycle. The mounting of cleaning chamber cabinet 13 directly atop solvent reservoir 35 accomplishes two objectives, to wit: the economic utilization of space and the elimination of piping between the two components.

Solvent reservoir 35 is a tank having a capacity of approximately 35 gallons. Its V-bottom construction causes particulate contaminants to settle toward solvent reservoir recess 32. Solvent reservoir 35 is covered by insulation 81 and its outside walls to minimize heat gain of the solvent from the outside environment. A pump 34 is provided to withdraw solvent and contaminants from recess 32, through pickup tube 33. The discharge from pump 34 is connected to a circulating conduit 38, which is connected through a filter 37 back to solvent reservoir 35. Filter 37 is adapted to remove particulate matter suspended in the solvent down to and including 0.2 microns. Filter 37 may also be substituted with absorber 37*a* or operated in series with absorber 37*a* for removal of soluable contaminants. Pump 34 is a high volume, low pressure pump. The volume delivered by pump 34 is sufficient to recirculate the entire capacity of solvent reservoir through filter 37 at least once every minute. Accordingly, the solvent in solvent reservoir 35 is continuously decontaminated so that the level of contamination therein is kept quite low. The contaminants are collected in filter 37 and/or absorber 37*a* which can be changed as necessary. Conduit 45 is provided so that filter 37 can be drained for purposes of changing said filter.

High pressure pump 39 is supplied with solvent from recirculation conduit 38 by a supply conduit 36. Supply conduit 36 is connected to recirculation conduit 38 downstream from filter 37, whereby the solvent supply to high pressure pump 39 has been filtered and/or absorbed, and is therefore clean when used for the decontamination of articles. Since pump 39 pumps a volume substantially smaller than that pumped by pump 34, pump 39 is always supplied with a positive pressure with which to satisfy its requirements. Pump 39 is a positive displacement pump which has been designed to pump solvent at any and all hydraulic pressures between 0 psig and 2150 psig through conduit 41 to cleaning chamber 11. Unloader valve 42 is provided in conduit 41 so that when spray gun 24 is not operated, the pressure solvent from pump 39 is diverted to solvent reservoir 35 through conduit 43.

Conduit 41 is connected to conduit 44 located inside cleaning chamber 11. Conduit 44 is a flexible hose with sufficient strength to withstand the hydraulic pressure delivered by pump 39. The purpose of using flexible hose is to allow the operator to manipulate spray gun 24. Spray gun 24 is equipped with nozzle 78 that has an orifice of small diameter. When solvent is pumped through conduit 44, a high pressure is generated because of the restriction created by the orifice. Said solvent emerges from nozzle 45 as high pressure spray 23, which can be directed against the object to be decontaminated. Nozzle 45 can be interchanged with other nozzles that have varying orifice diameters to achieve a range of pressures in solvent spray 23. This allows the operator to select a lower pressure for cleaning delicate objects, or a higher pressure for cleaning objects that have more tightly adhered contaminants.

In the ultrasonic decontamination process, ultrasonic cleaning tank 25 is filled with solvent by spray gun 24. Articles are decontaminated through this process by immersing them in tank 25 and energizing ultrasonic generator 27. At the completion of cleaning, the operator opens valve 46 and drains the solvent/contaminant mixture from tank 25 through conduit 47. Said solvent-/contaminant mixture flows through drain 21 into solvent reservoir 35. When the ultrasonic cleaning process is to be used again, the operator closes valve 46 and pumps more solvent into said tank through spray gun 24. By this process, cleaning tank 25 is replenished with decontaminated solvent.

After articles have been decontaminated, by either solvent spraying or ultrasonics, they must be dried of solvent for the purpose of preventing removal of solvent liquids from cleaning chamber 11. Fan 55 serves in the capacity of drying articles by pulling solvent vapor-/air mixtures out of cleaning chamber 11 through drain 21 and across cooling coil 31. Cooling coil 31 condenses the solvent vapor components out of said mixture, which then drain into solvent reservoir 35. The remaining components are recirculated through conduit 53 and discharged into plenum 51. The plenum 51 is equipped with multiple openings 52 that communicate directly with cleaning chamber 11. Plenum 51 is conformed to distribute the discharge of fan 55 evenly across cleaning chamber 52.

When using the solvent cleaning process, a large internal pressure surge is created by solvent spray 23. This pressure surge is relieved through conduit 73, which is connected to a column of activated charcoal (carbon) 76. Carbon column 76 removes solvent vapors that would otherwise be released to the environment. The gases then fed through conduit 74 to high efficiency particulate air (HEPA) filter 77, that remove 99.97% of all suspended particulate contaminants measuring 0.3 microns and larger, whereupon the gas which is now clean air, is vented to the atmosphere.

After the initial surge of pressure, substantially all of the air in cleaning chamber 11 is removed, and the atmosphere within cleaning chamber 11 consists primarily of solvent vapors. The solvent condenses quickly, causing a relative negative pressure to be created within cleaning chamber 11. Air is prevented from re-entering cleaning chamber 11 and equalizing the pressure inside by the resistance of filter 77 and carbon column 76. The relative negative pressure inside cleaning chamber 11 provides a safety feature in that it prevents leaks of contaminants from the interior of the chamber.

After a period of operation, the level of dissolved, rather than suspended, contaminants in the solvent may increase to a level such that when the objects are dried after cleaning, a film of contaminants is left thereupon. In order to remove the dissolved contaminants from the solvent, a still 40 is provided. Still 40 has the capacity to distill at one time the entire volume of solvent in the system. Still 40 comprises generally a vessel having a false bottom 54 which forms a cavity 56. Cavity 56 is filled with a heat transfer oil and has disposed therein a plurality of heating elements 57. Heating elements 57 are designed to heat the heat transfer oil to a desired temperature at or above the boiling point of the solvent. Still 40 is covered by insulation 81, which minimizes heat loss during distillation.

Still 40 is connected to recirculation conduit 38 by a conduit 48, which has therein electrically operated valve 49. When it is desired to distill the solvent, valve 49 is opened automatically and valve 50 is shut. Pump 34 is started to pump the entire contents of solvent reservoir 35 and filter 37 into still 40. Heating elements 57 are then actuated to be at the oil bath and thereby heat the solvent contained within still 40. When the temperature within still 40 reaches the boiling point of the solvent, that temperature is maintained according to the laws of the thermodynamics until substantially all of the solvent has been evaporated, whereupon the temperature begins to rise. When the temperature reaches a preselected setpoint above the boiling point of the solvent, thermostat 58 automatically deenergizes heaters 57.

The solvent vapor from still 40 is removed by conduit 59, which is connected to solvent reservoir 35. The solvent vapors from still 40 are condensed by cooling coil 31 to form pure liquid solvent, and return to solvent reservoir 35.

Cleaning chamber 11 is also equipped with a means for lighting the interior of said chamber so that the operator may better view the articles being decontaminated. Light housing 60 is mounted atop cabinet 13. Two fluorescent light bulbs 63 are provided in said housing, which shine through transparent window 65 and an opening **65*a* provided in the top of cabinet 13. Gasket 61 is provided to seal window 65 against cabinet 13 for the purpose of preventing leakage of solvent and contaminants from cleaning chamber 11. Fluorescent light bulbs 63 can be accessed for changing through the top of light housing 60 without having to disturb gasket 61 or cabinet 13**.

Cleaning chamber 11 is also equipped with two electrical switches, which are mounted on the inside wall of said chamber. Electrical switch 62 is designed to start and stop ultrasonic generator 27. Electrical switch 64 is operated to start and stop high pressure pump 39. Electrical switches 62 and 64 are located inside cleaning chamber 11 to allow the operator to conveniently operate equipment necessary to perform decontamination. These switches are sealed to preclude leakage of solvent and contaminants from cleaning chamber 11.

Control panel 72 is mounted on the machine as shown in FIG. 1. Various switches and alarm lights are mounted on said panel.

The preferred embodiment is equipped to allow the solvent spray process to be performed in special equipment remote from the cleaning chamber 11. Said special equipment may be adapted to clean objects that are too large or cumbersome to be cleaned inside cleaning chamber 11, and may take the form of very large cleaning chambers, or special chambers equipped to handle long tubular objects such as pipe or hose. When remote equipment is used, the apparatus functions in the same manner as described previously herein, except hose from the remote equipment is connected to special fitting 68 (FIG. 2) provided for such purpose. Special fitting 68 operates in such a manner that is automatically remains shut when remote equipment (not shown) is not being used. Solvent from high pressure pump 39 is thereby diverted to the remote equipment for the purpose of decontaminating articles. Solvent sprayed in the remote equipment and the contaminants thereby collected are returned by means of a pump located within the remote equipment. Solvent is returned from the remote equipment by means of flexible conduit that connects to fitting 66 located on cabinet 13. The returned solvent/contaminant mixture flows through drain 21 and is processed in the same manner as described before herein.

Drying ventilation may also be provided when remote equipment is operated. Conduit for fresh air to the remote equipment is connected at fitting 67, located on plenum 57. Doors 70 are provided to shut and seal openings 52 in cleaning chamber 11, causing exhaust air from fan 55 to be diverted to the remote equipment. Air is returned from the remote equipment by means of conduit connected to fitting 69. The return air/vapor mixture flows through drain 21 and thereby processed in the same manner as described before herein.

Components of the apparatus as described herein are mounted on frame 75, which is constructed of rugged steel of sufficient strength to support the weight of said components. Frame 75 is supported by casters 71, so that the apparatus can be rolled from one location to another as necessary. Casters 75 can be locked as necessary to prevent them from rolling.

The apparatus as described herein measures approximately 36" wide and 70" long, and the volume of cleaning chamber 11 is approximately 18.4 cubic feet. The arrangexent of components on the apparatus is judicious and economical so as to provide a compact apparatus that is easily maneuvered about on casters 71. The 36 inch width of the apparatus enables it to pass through standard door openings.

The primary thurst in achieving compactness is by the judicious location of solvent reservoir 35 and still 40. Cleaning chamber 11 is disposed vertically so that glove ports 20 and gloves **20*a* are at the comfortable height for arms on an average operator. The space below cleaning chamber 11 is then used to locate solvent tank 35, still 40, and refrigeration package 30. By locating solvent tank 35 below cleaning chamber drain 21, solvent can communicate from cleaning chamber 11** without utilizing conduits.

The function and arrangexent of cooling coil 31 is particularly unique. The judicious location of cooling coil 31 in the region between cleaning chamber 11 and solvent reservoir 35 enables it to perform four separate functions without the need of complex piping and valving arrangements:

1. It communicates closely with solvent drained from cleaning chamber 11 to solvent reservoir 35, thus keeping the solvent cool.
2. It is located in the flow path of the air/vapor mixture recycled through cleaning chamber 11 during drying, and thereby condenses vapors from the mixture.
3. It condenses vapors passing from still 40 to solvent reservoir 35 during the distillation process.
4. It condenses solvent vapor normally given off by solvent stored in solvent reservoir 35 due to solvent vapor pressure.

The location and diversity of utilization of cooling coil 31 also accomplishes economical use of space. The judicious location of cooling coil 21 precludes the need for a cooling coil for each separate function, thus minimizing space requirements. The location also eliminates the need for a separate housing, and piping to such housing, further minimizing space requirements.

It is to be understood that the present invention is not to be taken as being limited to the accompanying drawings and specification. While a particular embodiment of the present invention has been herein illustrated and described, it is not intended to limit the invention to such disclosure, but changes and modifications may be made therein and thereto.

It is also to be understood that the phraseology and terminology herein employed are for purposes of description and not of limitation, since the scope of the present invention is denoted in the appended claims.

What is claimed is:

1. A self contained, portable apparatus for cleaning chemically and/or radioactively contaminated articles comprising:

(a) a cleaning chamber in which contaminated articles are placed;

(b) a solvent reservoir containing an initial charge of solvent positioned substantially directly below said cleaning chamber;

(c) a short vertical duct connecting said cleaning chamber to said solvent reservoir, said short vertical duct being open to both said cleaning chamber and said solvent reservoir;

(d) means for delivering solvent from said solvent reservoir to a spray nozzle in said cleaning chamber at pressures ranging from 0 PSIG to 2150 PSIG to flush contaminants from the article being cleaned;

(e) means for filtering particulate contaminants such as radioactive particulate contaminants from the solvent before the solvent is delivered to said cleaning chamber;

(f) a high efficiency particulate air filter connected in series with an adsorber through which the initial atmosphere contained within said cleaning chamber is vented when spraying of solvent through said spray nozzles is connected;

(g) cooling means within said short, vertical duct, said cooling means condensing the solvent vaporized during cleaning operation thereby maintaining said apparatus at subatmospheric pressure during operation.

2. An apparatus as recited in claim 1, said means for delivering solvent comprising:

(a) a pump taking suction from said solvent reservoir;

(b) a conduit from said pump to said spray nozzle located within said cleaning chamber in fluid communication with said pump.

3. An apparatus as recited in claim 2, further comprising:

means for maintaining the pressure within said apparatus during operation at less than atmospheric pressure to ensure that no contaminants are permitted to escape.

4. An apparatus as recited in claim 2, further comprising:

an ultrasonic cleaning tank located within said cleaning chamber.

5. An apparatus as recited in claim 2, further comprising:

(a) a viewing window through which the operator of said apparatus has visual access to said cleaning chamber;

(b) a pair of impermeable gloves attached to said viewing window, said impermeable gloves being useful in the manipulation of articles within said cleaning chamber from the exterior of said apparatus.

6. An apparatus as recited in claim 5, wherein:

said spray nozzle is manually manipulable through said pair of impermeable gloves.

7. An apparatus as recited in claim 2, further comprising:

fitting means through which said means for delivering solvent can transmit solvent to a remote cleaning chamber for cleaning articles which are too large to fit within said cleaning chamber.

8. An apparatus as recited in claim 1, further comprising:

an open grating separating said cleaning chamber from said solvent reservoir through which solvent in both liquid and vapor phase can pass.

9. An apparatus as recited in claim 1, further comprising:

distillation means into which the solvent contained in said solvent reservoir is periodically circulated for removal of dissolved contaminants.

10. An apparatus as recited in claim 1, further comprising:

adsorber means connected in series with said means for filtering to effect removal of contaminants dissolved in the solvent before the solvent is delivered to the cleaning chamber.

11. A self contained, portable cleaning apparatus for cleaning chemically and/or radioactively contaminated articles comprising:

(a) a cleaning chamber;

(b) a vertical duct extending downward from said cleaning chamber to connect to a solvent reservoir;

(c) cooling means located within said vertical duct;

(d) means for delivering solvent from said solvent reservoir to said cleaning chamber;

(e) filter means for removing particulates from the solvent before the solvent is delivered to said cleaning chamber;

(f) a plenum means located within said cleaning chamber;

(g) a conduit attached at a first end to said vertical duct below said cooling means and attached as second end to said plenum means;

(h) fan means for circulating solvent vapor from said cleaning chamber through said vertical duct, across said cooling means, through said conduit and said plenum means and back to said cleaning chamber;

(i) a high efficiency particulate air filter through which any air initially contained within said apparatus is vented;

(j) an adsorber connected in series with said high efficiency particulate air filter to prevent any solvent from escaping when said apparatus is vented.

* * * * *